US010113782B2

(12) United States Patent
Karkhanis et al.

(10) Patent No.: US 10,113,782 B2
(45) **Date of Patent: *Oct. 30, 2018**

(54) STAGING ACTIVE COOLING START-UP

(71) Applicant: Johnson Controls Technology Company, Plymouth, MI (US)

(72) Inventors: Rajiv Karkhanis, York, PA (US); Curtis Wayne Caskey, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/394,495

(22) Filed: Dec. 29, 2016

(65) Prior Publication Data

US 2017/0176075 A1 Jun. 22, 2017

Related U.S. Application Data

(63) Continuation of application No. 14/322,534, filed on Jul. 2, 2014, now Pat. No. 9,534,822.

(60) Provisional application No. 61/842,121, filed on Jul. 2, 2013.

(51) Int. Cl.
*F25B 49/02* (2006.01)

(52) U.S. Cl.
CPC ..... *F25B 49/022* (2013.01); *F25B 2400/06* (2013.01); *F25B 2400/13* (2013.01); *F25B 2500/26* (2013.01); *F25B 2700/2104* (2013.01)

(58) Field of Classification Search
CPC ..... F25B 49/022; F25B 2400/13; F25B 2500/26; F25B 2700/2104; F25B 2700/21175
USPC ..... 62/175, 228.1, 228.5
See application file for complete search history.

(56) References Cited

U.S. PATENT DOCUMENTS

| | | | | |
|---|---|---|---|---|
| 4,483,152 | A | 11/1984 | Bitondo | |
| 4,679,404 | A * | 7/1987 | Alsenz | F25B 49/022 236/78 D |
| 5,231,846 | A * | 8/1993 | Goshaw | F04C 28/02 417/8 |
| 5,797,729 | A * | 8/1998 | Rafuse, Jr. | F04B 49/20 417/3 |
| 6,185,946 | B1 | 2/2001 | Hartman | |
| 6,233,954 | B1 | 5/2001 | Mehaffey et al. | |

(Continued)

*Primary Examiner* — Timothy L Maust
(74) *Attorney, Agent, or Firm* — Fletcher Yoder, P.C.

(57) ABSTRACT

A novel process for activating available compressors in multiple compressor air conditioning systems, using an Optimum Stage-Up Process. This process is programmed into a controller as an algorithm, to provide a process for fast compressor start. This process shortens the time to initiate operation of compressors in a multi-compressor air conditioning system required to meet the demand call under any load condition, and hence shortens the time required for the actual sensed interior region air temperature to reach the interior region temperature set point. The Optimum Stage-up Algorithm estimates the number of compressor stages or steps that must be initiated, based on sensed or measured values, to meet the demand at any load condition. These measured values include the sensed temperature of the interior region being cooled, which is compared to the temperature set point of this interior region as well as measured mixed air temperature and supply air temperature.

23 Claims, 1 Drawing Sheet

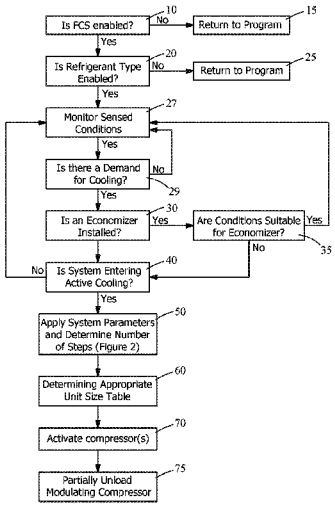

(56) References Cited

U.S. PATENT DOCUMENTS

| | | | | |
|---|---|---|---|---|
| 6,370,888 | B1 * | 4/2002 | Grabon | F04B 49/20 62/115 |
| 7,287,395 | B2 * | 10/2007 | Nash, Jr. | F25B 49/022 62/175 |
| 7,661,274 | B2 | 2/2010 | Crane et al. | |
| 7,793,509 | B2 * | 9/2010 | Crane | F25B 49/025 417/2 |
| 9,038,404 | B2 * | 5/2015 | Judge | H05K 7/20827 62/225 |
| 9,534,822 | B2 * | 1/2017 | Karkhanis | F25B 49/022 |

* cited by examiner

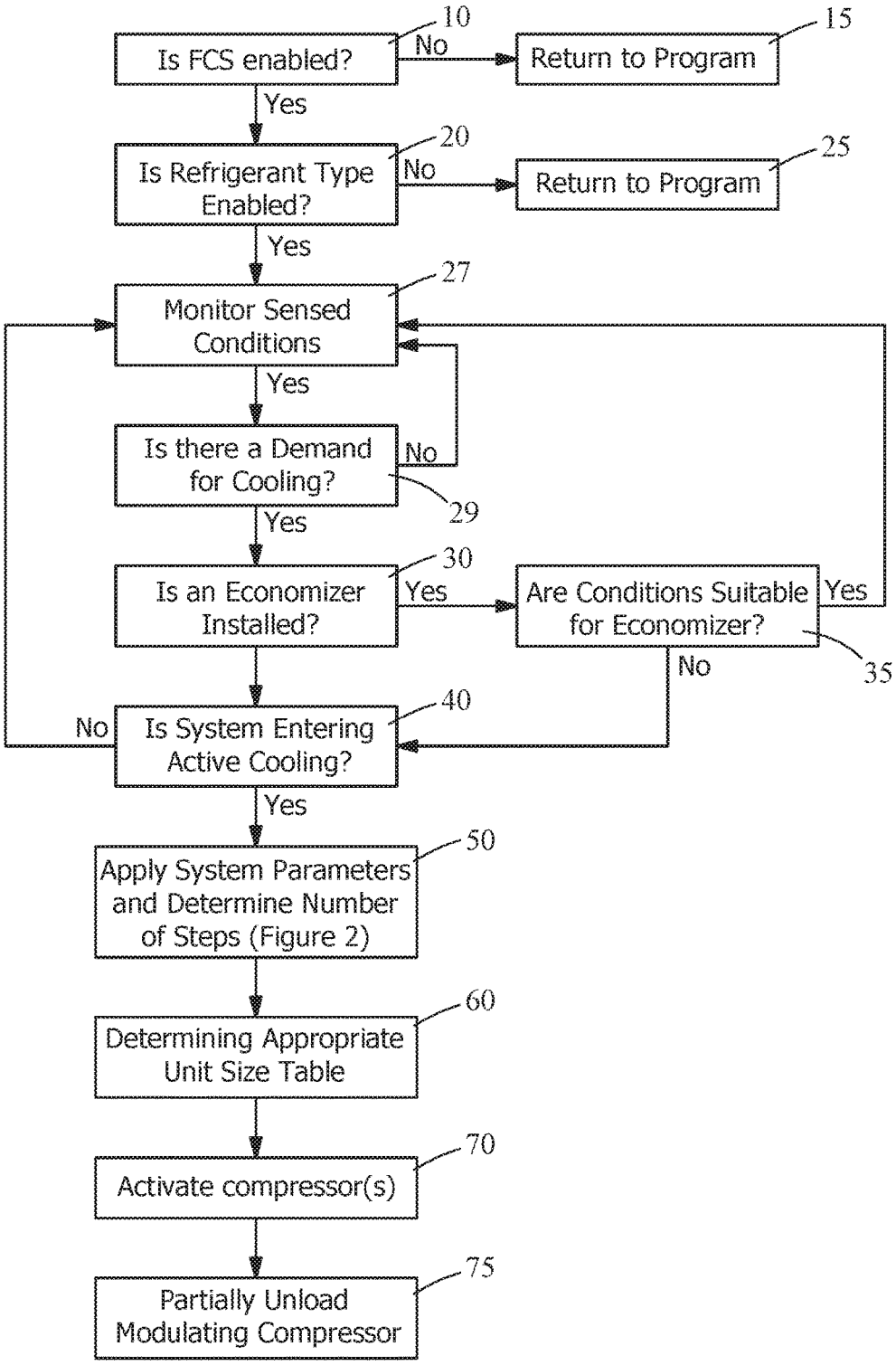
Is FCS enabled?
10
No
Return to Program
15
Yes
Is Refrigerant Type Enabled?
20
No
Return to Program
25
Yes
Monitor Sensed Conditions
27
Yes
Is there a Demand for Cooling?
No
29
Yes
Is an Economizer Installed?
30
Yes
Are Conditions Suitable for Economizer?
Yes
No
35
No
Is System Entering Active Cooling?
40
Yes
Apply System Parameters and Determine Number of Steps (Figure 2)
50
Determining Appropriate Unit Size Table
60
Activate compressor(s)
70
Partially Unload Modulating Compressor
75

STAGING ACTIVE COOLING START-UP

CROSS REFERENCE TO RELATED APPLICATIONS

This application is a continuation of U.S. patent application Ser. No. 14/322,534, filed on Jul. 2, 2014, entitled "Staging Active Cooling Start-Up," which claims priority to U.S. Provisional Patent Application Ser. No. 61/842,121, filed on Jul. 2, 2013, entitled "Staging Active Cooling Start-Up," which are incorporated herein by reference in their entirety.

FIELD OF THE INVENTION

The present invention is directed to rapid initialization of cooling in a multi-compressor system to obtain rapid cooling of an interior region.

BACKGROUND OF THE INVENTION

In multi-compressor air conditioning systems, such as may be installed on a roof-top (identified as roof-top units even though frequently positioned in some other convenient location but still referred to as roof-top units regardless of location), an active cooling mode is entered into by the system when a cooling demand is called for by a controller in response to a sensed temperature. Such a multi-compressor air conditioning system may or may not utilize an economizer. Briefly, economizers are used to provide energy savings by reducing the need for mechanical cooling by the compressors in the multi-compressor system by taking advantage of ambient temperature and humidity when it is lower than that of interior air. Economizers may also provide a reduction of indoor $CO_2$ levels. Economizers also are controlled by the controller, which monitors installed sensors positioned at various locations inside the rooftop unit, inside the interior region and outside the building. The installed sensors monitor temperature and humidity levels inside and outside the building, as well as $CO_2$ sensors to monitor conditions inside the building. This information is sent to the controller which then determines system operation, adjusting economizer operation that the proper configuration to control outside air input into the building, based on sensed conditions.

The controller may be provided with a setting that disables economizer logic and operation, which is useful when no economizer is installed. However, the controller may be programmed without such a setting, so that the programmed controller may be used universally, i.e. shipped from the factory, without regard as to whether the multi-compressor system will be used with an economizer. When programmed in this manner, the controller first checks to determine whether an economizer is installed, before entering into the active cooling mode.

Based on sensed conditions in both the interior region and outside, when the controller determines cooling is needed and either determines that conditions are not suitable for activation of the economizer, or determines that an economizer is not installed, the controller is programmed to stage compressor operation individually and in seriatim to control the indoor supply air temperature so that the actual sensed interior region air temperature at a preselected location reaches the interior region temperature set point. While this approach works well, it does have a few disadvantages. For example, once the controller activates a compressor, it is not known immediately how much the sensed interior region temperature will drop upon compressor activation.

The controller is programmed to initialize the operation of the first compressor and operate it for a preselected, preprogrammed period of time, usually 3½ minutes, while monitoring the sensed interior region temperature and comparing it to the interior region temperature set point before implementing further action. At the end of this preprogrammed period of time, the controller, using a Cooling Control Offset calculation procedure, an algorithm programmed into the controller, may initiate start-up of the next compressor in a multi-compressor system. This algorithm may vary from system to system, but evaluates the need for an additional compressor to further reduce the interior region temperature. This process is repeated after each additional compressor is brought online, until the actual sensed interior region temperature matches, or is within a predetermined tolerance range, of the interior region temperature set point. Of course, if the load is high, it could take a substantial amount of time to initiate operation of all compressors in the multi-compressor system. For example, in a system having six compressors, that is, a six stage unit, it may take in excess of twenty minutes to initiate operation of all six compressors in high load conditions. Such a time delay also postpones the time for the actual sensed interior region temperature to match the interior region temperature set point. What is needed is a system that maximizes compressor usage in a multi-compressor system to achieve matching of the actual sensed interior region temperature to the interior region temperature set point as quickly as possible.

BRIEF DESCRIPTION OF THE INVENTION

In order to achieve rapid equalization between the interior region temperature set point and the sensed or measured interior region temperature, and to overcome the disadvantages of the startup procedures such as described above, the present invention utilizes a novel process for activating available compressors in multiple compressor air conditioning systems, hereinafter referred to as Optimum Stage-Up Process. This process may be conveniently programmed into a controller as an algorithm, which is referred to as the Optimum Stage-up Algorithm which may be used interchangeably herein with the terms Fast Compressor Start (FAST COMP START) or fast compressor start ("FCS") and their acronyms. This FCS process shortens the time to initiate operation of compressors in a multi-compressor air conditioning system required to meet the demand call under any load condition, and hence shortens the time required for the actual sensed interior region air temperature to reach the interior region temperature set point.

The Optimum Stage-up Algorithm estimates the number of compressor stages or steps that must be initiated, based on sensed or measured values, to meet the demand at any load condition. These sensed or measured values include the sensed or measured temperature of the interior region being cooled, which is compared to the temperature set point of this interior region as well as mixed air temperature and supply air temperature. Other variables that may be considered in the algorithm programmed into the controller include variable supply fan speed, when variable supply fan speed is provided. Variable fan speed may be represented by a value greater than 0 up to 100% or a fractional value greater than 0 up to 1. When variable supply fan speed is not available, the variable supply fan speed default is 100%, that is, when the system is operational, the fan speed is operating at 100% speed which may be represented by 1. A constant determined by the refrigerant capacity of the system may also be utilized by the controller. Since the refrigerant capacity of each system may be different, this constant indicative of refrigerant capacity may be programmed into the controller into the system at time of installation or manufacture. Since the refrigerant capacity is a fixed but programmable value, it may be updated by reprogramming the controller when the system is refurbished or otherwise altered.

The controller initiates compressor operation as required to meet the demand without operating each compressor individually for a preprogrammed, predetermined time period to determine further need. Thus, operation of one compressor or simultaneous operation of multiple compressors may be initiated depending on the determination of Optimum Stage-up Algorithm. As used herein, simultaneous operation of multiple compressor systems means sequential staging of each additional required compressor by the controller after a predetermined amount of time, the predetermined amount of time being a minimum delay required solely to avoid electrical overload due to electrical service limitations. Additional compressors are brought on line by the controller in this fashion until all required compressors in the fast start sequence are brought on line, completing the staging cycle.

The Optimum Stage-up Algorithm may be programmed into a controller as a user selectable option, although the algorithm may be a default setting if desired. However, when the controller is operational with the Optimum Stage-up Algorithm, the multi-compressor air conditioning system is initialized using the Fast Compressor Start logic. The basic steps of the FCS are set forth in FIG. 1. It will be understood by those skilled in the art that additional steps may be included based on other system variables. The FCS logic may also utilize one or both of a FCS equation and a number of Tables programmed into the controller that are based on installed system hardware and capabilities. It will be understood that the FCS equation and these Tables may be installed at system installation and may be upgraded from time to time as the system is upgraded. In addition, the Tables may be modified and reinstalled into the controller after the system is installed, either as the multi-compressor system is upgraded or as the information in the Tables is refined. Systems or sizes not identified herein may utilize additional Tables not identified. It will be recognized by those skilled in the art that the information set forth in the tables is exemplary, since there compressor sizes can be changed and the number of compressors in a multiple compressor system can be varied. The Tables and systems described herein are illustrative of operation of FCS logic with a multiple compressor air conditioning system.

Other features and advantages of the present invention will be apparent from the following more detailed description of the preferred embodiment, taken in conjunction with the accompanying drawing which illustrates, by way of example, the principles of the invention.

BRIEF DESCRIPTION OF THE DRAWINGS

FIG. 1 is a flow chart providing a graphical representation of the logic of a Fast Compressor Start (FCS) logic programmed into a controller controlling the operation of a multi-compressor air conditioning system.

DETAILED DESCRIPTION OF THE DRAWINGS

In a broad embodiment of the present invention, an Optimum Stage-up Algorithm is programmed into a controller. The algorithm sets forth the method that the controller utilizes to activate one or more compressors in a multi-compressor air conditioning system so as to equalize the monitored or sensed temperature in the interior region of a building with the interior region set point temperature. The algorithm preprogrammed into the controller may be a user-selectable option or may be a default setting for controller operation.

Referring to FIG. 1, when the FCS Algorithm is programmed into a controller as a user selectable option, then the first step for activating the FCS operation is to select the FCS option, step 10, which must be selected by the user. Obviously, if the FCS option is not elected, the controller will continue normal operation, step 15. If the FCS option is programmed into the controller as the default operation, step 10 will be automatically executed. While it may be disabled from execution as the default operation by the user, this would require an affirmative step by the user.

Once the FCS operation is initiated, the controller may determine the refrigerant type based on the refrigerant installed in the system. This may be programmed into the controller at the factory or determined at system installation and programmed into the controller. In any event, during any system retrofit, if the refrigerant type used in the system is changed, the programming in the controller may be updated to reflect the change, step 20. It also may be possible to utilize a sensor to detect the refrigerant type installed in the system, the sensor signaling the controller the refrigerant type. If the system refrigerant does not match the initially programmed refrigerant or detected refrigerant, the FCS algorithm may not allow the controller to operate the system in FCS mode, instead returning the controller operation to normal operations. As discussed above, in normal operations, the controller is programmed to initiate start up of a first compressor and operate it for a preselected, preprogrammed period of time before proceeding with a determination of the need to initiate operation of a second, additional compressor. As should be clear, if the system is modified to change the refrigerant, the controller should be reprogrammed to indicate this change. Alternatively, if a means for detecting the refrigerant type is installed, such as a sensor, the sensor will signal the controller as to the change. In either event, when the refrigerant actually in use in the system does not match the refrigerant setting in the controller may result in FCS operation being disabled. Conversely, a system having the FCS disabled initially due to a discrepancy between the programmed refrigeration and the actual installed refrigerant may gain access to the FCS algorithm when this discrepancy is corrected. In a preferred embodiment, steps 10 and 20 are performed during initial operation of the system after installation or after shut down, and are not repeated unless FCS operation is overridden by an operator or the system is shut down, such as a for maintenance. System shut down, as used herein means complete disconnection of the air conditioning system from its power sources so that it can be disassembled, such as for maintenance or replacement of one or more components. System shut down does not mean compressor(s) inactivity for any period of time due to a lack of demand or call for compressor operation.

In another embodiment, a plurality of FCS programs may be programmed into a controller, each of the FCS programs specific to a specific refrigerant. This would be particularly desirable when a sensor is available to detect the refrigerant in the system so that selection of the proper program is automatically determined by the controller based on sensor input. When an automatic determination is not provided, requiring a technician to select the proper FCS program based on a change in the refrigerant in the system such as may occur during a maintenance operation, a possibility exists that the technician could select the wrong program, causing the controller to execute FCS operation for a different refrigerant than actually installed in the system.

If the refrigerant type in the system is not enabled, the controller will stop the execution of the FCS algorithm or program, and normal controller operation will continue, step 25. As noted above, it is preferred that steps 10 and 20 be performed during initial operation of the system in FCS mode after installation or shut down, these steps not being repeated unless FCS operation is overridden by an operator or the system is shut down.

The controller then proceeds with system monitoring, step 27. The controller is constantly monitoring sensed conditions which include comparing the sensed interior region (room) air temperature with the interior region (room) temperature set point to determine whether there is a demand for cooling, step 29. When the sensed interior region air temperature and interior region temperature set point correspond, there is no demand for cooling and the controller continues its system monitoring function in step 27, taking no further action. As used herein, the term (or its equivalent) "correspondence of sensed interior region air temperature and interior region temperature set point" means that the sensed interior region air temperature equals the interior region temperature set point or exceeds the interior region temperature set point by a predetermined amount, this amount being programmed into the FCS algorithm. Preferably, the differential between the sensed interior region air temperature and the interior region temperature set point is +1-3° F., that is, the sensed interior region air temperature exceeds the interior region set point by a predetermined amount within the range of 1-3° F. This is to minimize or eliminate constant activation and inactivation of compressors, referred to as "hunting."

Once the sensed interior region set point and the interior region temperature set point no longer correspond, then there is a demand for cooling, step 29 and cooling is activated.

System operation in FCS mode now results in activation of cooling, the controller next determining whether an economizer is installed in the system, step 30. The presence or absence of an economizer may be a manual setting in the controller or a preprogrammed setting in the controller identifying economizer presence, or may be a function or subroutine provided in the controller programming requiring the controller to scan the system to determine whether an economizer and its related sensors are installed and are operational. Once the controller determines that an economizer is installed in the system in step 30, the controller evaluates signals and inputs from various sensors associated with economizer operation installed in the system, including those installed to monitor the outside environment as well as the environment within the building so that the controller may determine whether conditions are suitable for economizer operations and whether economizer operation will satisfy the cooling demand or contribute to satisfying the cooling demand, step 35.

In step 35, when conditions are suitable for economizer operation and economizer operation can satisfy the cooling demand in step 29, the FCS program terminates further execution of FCS operation, since no compressor starting is required when cooling can be provided solely by economizer operation. Controller operation, step 27, returns the controller to monitoring status, that is, monitoring sensors and evaluating the input from these sensors to determine whether the sensed interior region air temperature and interior region temperature set point correspond. As long as there is a demand for cooling in step 29, and the controller determines from signals of sensed conditions that economizer operation alone is not suitable, or that conditions for economizer operation are not suitable, step 35, or if there is no installed economizer, step 30, then the FCS program determines whether the system should be entering the active cooling mode, step 40. Of course, if active cooling mode is not imminent, the system continues monitoring conditions, step 27, to identify when active cooling should be initiated if active cooling is not engaged.

Once the determination is made that active cooling should be engaged, step 40, the sensed interior region temperature, which may be for example, one of an interior region temperature sensor or a return air temperature sensor, and a sensed outdoor temperature is applied to the FCS algorithm along with a plurality of additional parameters, both programmed and sensed, to estimate proper compressor operation for start up. The FCS algorithm programmed into the controller first estimates the number of stages of cooling that are required based on these sensed and programmed parameters. The FCS program utilizes MIXED AIR TEMPERATURE (MAT) calculation, which is a calculated value based on a mixture of cooling air and the return air temperatures. These temperatures are sensed and the calculated values of MAT determined, usually measured before any cooling takes place, such as by an economizer or by an evaporator coil downstream of a filter. This MAT may be determined by sensing the temperature of return air mixed with the temperature of the outdoor air when economizer operation is suitable, and cooling due to evaporator coil cooling downstream of the air filter, either when economizer operation is not suitable or when economizer air alone is insufficient to provide the necessary cooling. While a dedicated Mixed Air Temperature sensor may be used, it will be understood by those skilled in the art that a dedicated Mixed Air Temperature sensor is not required, and any sensor or combination of sensors measuring the temperature of the return air, the outside air or a mixture of the return air and outside air may be used. For example, the measured temperature detected by the Supply Air Temperature sensor, before compressor start-up, can be used for this purpose.

The SUPPLY AIR TEMPERATURE SET POINT (SATSP) is also used in the algorithm. This is usually a fixed temperature programmed into the controller. The SATSP can be programmed into a controller, either as a Table or as a separate algorithm, the value of the SATSP, however determined, being provided to the FCS program as a calculated value based on some other factor, such as, for example measured outside temperature. SATSP may also be entered manually or may be set in the FCS program as a default value. SATSP controls the target temperature of supply air provided to the interior region being cooled.

Supply fan VFD Speed (VFDSP) is a value based on a variable fan speed that is changeable from 0-100%. While this variable fan speed itself may be calculated from a separate but related algorithm, it also may provided to the FCS program from a separate Table using sensed conditions to determine the appropriate fan speed setting. The VFDSP controls the flow of air across the evaporator coils. This in turn controls the quantity of supply air provided to the interior region and, when used in conjunction with the compressors activated to provide cooling, can assist at maintaining the SATSP temperature. To simplify the discussion set forth herein, the fan speed setting is a value between 0-100% (fractionally between 0-1). If the system is not provided with a fan having variable speed capability, the fan setting is at constant volume and VFDSP is set to 1, that is, 100%. However, it will be understood that the controller can vary a variable VFDSP along with the number of compressors activated to maintain SATSP.

Design air flow is the air flow capacity at which the unit is designed to operate. Design air flow also is related to the VFDSP. The maximum design air flow occurs when VFDSP is at its maximum value, that is, when the fan speed setting is operating at 100%.

STAGE CAPACITY is a calculated value provided by the controller to the program. STAGE CAPACITY is based on the cooling capacity of the system and the associated total number of available steps. The cooling capacity is known at the time of installation (or shipment) and may be programmed into the controller. The cooling capacity of the system will vary depending on the number of compressors in the system and the cooling capacity of each of those compressors, the maximum cooling capacity being the sum of the cooling capacity of each of these compressors. For simplicity in conveying the concepts of the present invention, STAGE CAPACITY as used in EQ. 3 operates under an initial assumption that the compressors that are staged have the same or nearly the same cooling capacity. However, the invention and EQ. 3 are not so limited. The STAGE CAPACITY of each of the identified stages is a known value, as are the capacities of all of the compressors in the system. Once a required Stage is identified by the controller, the required capacity is also known, and the compressors in the system required to satisfy a particular identified Stage are also known. Thus, once the Stage is identified, required capacity can be satisfied by bringing compressors identified with that Stage on line sequentially, the capacity equaling or exceeding the minimum required capacity for the identified Stage. Thus, once the number of compressors in the system is known and the capacity of each compressor in the system is known, the specific compressors required to satisfy any required Stage may be programmed into the controller for use in satisfying a particular stage.

With these variables, the START STAGE for a system having a known UNIT Size or capacity can be calculated using Eq. 1 below. The START STAGE is calculated to determine, based on sensed conditions, the initial step number out of the total number of available steps that the controller should activate in order to achieve interior cooling rapidly and efficiently. Thus START STAGE is used interchangeably with Step Number. The Step Number identifies a specific step number of the available step numbers for any system. The specific step number identifies the specific compressors in a system that should be activated and their load capacity (when the compressors have variable capacity) to satisfy a cooling call using the FCS program.

$$\text{START STAGE}=[(\text{MAT}-\text{SATSP})*\text{VFDSP}]/\text{STEP DELTA} \quad \text{(EQ. 1)}$$

where

START STAGE=Initial compressor staging at start;

MAT=Mixed Air Temperature (° F.);

SATSP=Supply Air Temperature Set Point (° F.);

VFDSP=VFD Speed, 0-100% (or a decimal fraction between 0 and 1 when constant volume is assumed at 100%);

STEP DELTA=Temperature drop associated with each stage (° F.);

(STEP Delta from Table 1, below).

Alternate methods such as set forth using Eq. 2 or 3 below may be used to calculate the step number that is to be activated.

$$\text{REQ. CAPACITY}=4.5*\text{DESIGN AIR FLOW}*\text{VFDSP}*(\text{ENT ENTHALPY}-\text{LVG ENTHALPY}) \quad \text{(EQ. 2)}$$

where

REQ. CAPACITY=Required Capacity in BTUH;

DESIGN AIR FLOW=Design air flow in CFM;

VFDSP=VFD Speed, 0-100% (or a decimal value between 0 and 1 when constant volume is assumed at 100%);

ENT ENTHALPY=Enthalpy of entering mixed air (BTU/LB);

LVG ENTHALPY=Intended Enthalpy of leaving air (BTU/LB), where the intended enthalpy of leaving air is the leaving enthalpy setpoint based on saturated measured (sensed) supply air temperature and $$\text{START STAGE}=\text{REQ. CAPACITY}/\text{STAGE CAPACITY} \quad \text{(EQ. 3)}$$

where

START STAGE=Initial compressor stage at start;

REQ. CAPACITY=Required Capacity in BTUH (see EQ. 2);

STAGE CAPACITY=Capacity per stage (BTUH)

Using Eq. 1, once the START STAGE value or Step Number is calculated, since it may not be a whole number, it may be rounded to the nearest whole number. The controller using the FCS program identifies from the number of available steps and the step number and determines the compressors which should be activated to satisfy the cooling call. The controller, based on the START STAGE or Step Number, then stages compressor operation of the compressors associated with that Step Number. The number of available steps for any system is based on the number of compressors and the capacity of each of the compressors, which together provide total system capacity. The number of steps (and the compressors required to be activated associated with each specific step) thus may be programmed into the controller, and may be included in the appropriate Tables, providing the UNIT Size or capacity that are known values so that programming of this information can be accomplished at installation or factory shipment, or can be updated if the system is modified. The appropriate Tables identify, based on total system capacity for each system, the total number of steps available for a system as well as the compressors that must be activated for each step. The calculated number from Eq. 1 for START STAGE or Step Number which specific step of the number of steps available in the system should be used for a particular cooling call based on sensed conditions, which identifies the compressors that must be activated for that cooling call. The Tables further identify for each available step, the available compressors, whether they should be activated or not and, if activated, the appropriate load in terms of percentages, when modulation is available for one or more of the compressors. As will be recognized by those skilled in the art, if modulation such as may be provided by variable speed drives (VSDs), is not available to a compressor, it operates at 100% capacity or it does not operate, i.e. 0%.

To avoid electrical overload problems, when the FCS program identifies that more than one compressor must be activated to satisfy the active cooling mode, the controller staggers the starting of the compressors in seriatim so that the compressors are not started simultaneously, so that electrical overload is avoided. The controller activates the compressors as quickly as possible while avoiding electrical overload by maintaining a predetermined time lapse between starting successive compressors. Although any time lapse may be selected, it is preferred that at least 3 seconds, and more preferably at least 5 seconds elapse between start-up of successive compressors. However, the time delay should be no more than 20 seconds between start-up of successive compressors.

After the last compressor in the series is started, each of the compressors should run for a preselected period of time, preferably less than 5 minutes, more preferably 2-4 minutes, and most preferably 3.5 minutes or less before a typical Cooling Control Offset staging routine is initiated by the controller.

When the system includes one or more modulating compressors, (that is, compressors whose speed can be controlled and varied, such as compressors among the plurality of compressors controlled by a VSD, or compressors among the plurality of compressors that have digital unloading), and at least two compressors, but usually six or more compressors, further control of compressor stages or steps may be available. When such modulating compressors are available, the START STAGE may be evaluated with the modulating compressor(s) considered as non-modulating compressors. However, the modulation capability of such modulating compressors may be evaluated by using the compressor modulation capability to achieve further adjustments in capacity as needed. Stated alternatively, instead of rounding START STAGE to the nearest whole number, the capacity of the system can be adjusted to a value near the START STAGE by adjusting the capacity of at least one of the modulating compressors so operation is at less than 100% of capacity.

The Tables and Example set forth below are for multiple compressor units having refrigeration capacity from 25 tons to 105 tons and 2 to six compressors, each using the preferred refrigerant 410A. It will be recognized by those skilled in the art that the refrigeration capacity of the system may be increased by adding additional compressors. It will also be recognized by those skilled in the art that the capacity of any of the systems can be varied by substituting compressors having different capacities than the UNIT SIZE identified in the Tables. The overall system flexibility to rapidly cool an interior region quickly and efficiently becomes apparent from the following examples.

EXAMPLE 1

An air conditioning system has 50 tons of refrigeration capacity and utilizes a fan having variable speed capabilities. For this Example 1, the 50 tons of refrigeration capacity are provided by a compressor A having 20 tons of cooling capacity and two additional compressors B and C, each providing 15 tons of cooling capacity. Each of compressors A, B and C are capable of being modulated. In order to perform cooling in accordance with this disclosure, the controller runs the FCS program to maximize cooling capacity while running the available compressors as efficiently as possible. On a call for cooling in a system having 50 tons of capacity, the sensors provide measurements to the controller for calculation of the MAT as described above. In this example SATSP is set at 58° F. In this example, the return air, using a sensed return air temperature measurement, when mixed with the supply air provided at SATSP, yields a calculated value of MAT of 78° F. In addition, the controller utilizes a VFDSP of 75%. The controller also determines, in this example, that the sensed outside conditions make economizer usage unsuitable for providing all of the cooling, so that the system enters active cooling, see FIG. 1, step 40. The controller is programmed for operation of a 50 ton cooling system, the 50 tons of cooling being supplied by three compressors, each operated by a variable speed drive and having variable fan speed (VFDSP), which is programmed on start up to operate at 75% capacity. It will be recognized by those skilled in the art that SATSP and VFDSP are values programmed into the FCS program, but which may be varied as desired by changing the programmed values. Return air temperature is a sensed value, and MAT is a calculated value based on the sensed return air temperature and the programmed SATSP.

Next the FCS program estimates the Step Number required by calculating START STAGE. This value is calculated using Equation 1 above. MAT, SATSP and VFDSP are determined as discussed above. In order to determine STEP DELTA, the program next goes to Table 1, below, stored in the controller. STEP DELTA is stored in the controller and may be updated from time to time as required. From Table 1, reproduced below, it is determined that STEP DELTA for a 50 ton compressor system is 2.8. This number, if desired also may be entered into the FCS program at installation, since the total refrigeration capacity of the system is known at installation. However, it is preferred that the FCS program check Table 1 stored in the controller with each iteration of the program, since there is no additional effort required in executing the FCS program in this manner. It is also easier to update Table 1 in the controller by simply replacing it rather than having to reprogram the FCS program in the controller. Table 1 also indicates that there and a total of 9 available staging steps for a system having 50 tons of capacity utilizing three compressors.

The 2.8 input from Table 1 is used in Eq. 1 with a calculated MAT of 78° F., a SATSP of 58° F. and a VFDSP of 75% (0.75) 1 yielding a calculated START STAGE or Step Number (#) of 5.36, which is rounded to the nearest whole number, 5.

Next, the compressor staging is determined. Table 3 for a three compressor system, also programmed into the controller, provides information on all 9 of the Steps for a system having compressor capacity in the 50-60 ton range, which as discussed above, has three compressors. While all available Compressor Staging Tables, here the available compressor staging tables being Tables 2-5, may be stored in the controller, providing access by the FCS program to all the compressor staging tables, it is only necessary to store the relevant compressor staging table for the Cooling System in the controller, here Table 3, reproduced below with Tables 2-5. It will be recognized by those skilled in the art that air conditioning systems having larger cooling capacity may utilize additional compressors and have a different number for Compressor staging with different cycling of compressors. The FCS program is programmed with the total compressor capacity at installation (or at system retrofit), so only the relevant Table need by available to the FCS program. However, storing all of the Compressor Staging Tables is useful during retrofit or upgrade if the number of compressors in the System is modified, and the FCS program can include instructions directing it to the proper Compressor Staging Table when more than one Compressor Staging Table is provided.

In this Example 1, a 50 ton refrigeration capacity system having three compressors, compressors A, B and C, utilizes Step #5. From Table 3, Step #5 indicates that compressor A should be cycled on at a load of 67%, and one of either compressors B and C should be cycled on at a 100% load.

TABLE 1

| Step Delta | | |
|---|---|---|
| UNIT SIZE | Total # of Steps | STEP DELTA |
| 25 Ton thru 40 Ton | 6 | 4.0° F. |
| 50 Ton thru 60 Ton | 9 | 2.8° F. |
| 62 Ton thru 80 Ton | 12 | 2.0° F. |
| 95 Ton thru 105 Ton | 18 | 1.5° F. |

TABLE 2

| Compressor Staging, UNIT SIZE = 25 Ton, 32 Ton, 35 Ton, 40 Ton | | | | | | |
|---|---|---|---|---|---|---|
| | Step # | | | | | |
| | 1 | 2 | 3 | 4 | 5 | 6 |
| Compressor A | On | On | On | On | On | On |
| Compressor A Load | 33% | 67% | 100% | 33% | 67% | 100% |
| Compressor B | Off | Off | Off | On | On | On |

TABLE 3

| Compressor Staging, UNIT SIZE = 50 Ton, 60 Ton | | | | | | | | | |
|---|---|---|---|---|---|---|---|---|---|
| | Step # | | | | | | | | |
| | 1 | 2 | 3 | 4 | 5 | 6 | 7 | 8 | 9 |
| Compressor A | On | On | On | On | On | On | On | On | On |
| Compressor A Load | 33% | 67% | 100% | 33% | 67% | 100% | 33% | 67% | 100% |
| Compressor B | Off | Off | Off | 1 of 2 | 1 of 2 | 1 of 2 | On | On | On |
| Compressor C | Off | Off | Off | On | On | On | On | On | On |

TABLE 4

| Compressor Staging, UNIT SIZE = 62 Ton DU, 80 Ton DU | | | | | | | | | | | | |
|---|---|---|---|---|---|---|---|---|---|---|---|---|
| | Step # | | | | | | | | | | | |
| | 1 | 2 | 3 | 4 | 5 | 6 | 7 | 8 | 9 | 10 | 11 | 12 |
| Compressor A | On | On | On | On | On | On | On | On | On | On | On | On |
| Compressor A Load | 33% | 67% | 100% | 33% | 67% | 100% | 33% | 67% | 100% | 33% | 67% | 100% |
| Compressor B | Off | Off | Off | 1 of 3 | 1 of 3 | 1 of 3 | 2 of 3 | 2 of 3 | 2 of 3 | On | On | On |
| Compressor C | Off | Off | Off | On | On | On | On | On | On | On | On | On |
| Compressor D | Off | Off | Off | | | | | | | On | On | On |

TABLE 5

| Compressor Staging, UNIT SIZE = 95 Ton DU, 105 Ton DU | | | | | | | | | |
|---|---|---|---|---|---|---|---|---|---|
| | Step # | | | | | | | | |
| | 1 | 2 | 3 | 4 | 5 | 6 | 7 | 8 | 9 |
| Compressor A | On | On | On | On | On | On | On | On | On |
| Compressor A Load | 33% | 67% | 100% | 33% | 67% | 100% | 33% | 67% | 100% |
| Compressor B | Off | Off | Off | 1 of 5 | 1 of 5 | 1 of 5 | 2 of 5 | 2 of 5 | 2 of 5 |
| Compressor C | Off | Off | Off | On | On | On | On | On | On |
| Compressor D | Off | Off | Off | | | | | | |
| Compressor E | Off | Off | Off | | | | | | |
| Compressor F | Off | Off | Off | | | | | | |
| | Step # | | | | | | | | |
| | 10 | 11 | 12 | 13 | 14 | 15 | 16 | 17 | 18 |
| Compressor A | On | On | On | On | On | On | On | On | On |
| Compressor A Load | 33% | 67% | 100% | 33% | 67% | 100% | 33% | 67% | 100% |
| Compressor B | 3 of 5 | 3 of 5 | 3 of 5 | 4 of 5 | 4 of 5 | 4 of 5 | On | On | On |
| Compressor C | On | On | On | On | On | On | On | On | On |
| Compressor D | | | | | | | On | On | On |
| Compressor E | | | | | | | On | On | On |
| Compressor F | | | | | | | On | On | On |

EXAMPLE 2

In Example 2, assume the System Set-up, the variables and the measured or sensed values are identical of the values provided in FIG. 1. The only difference between the information provided in Example 1 and that provided in Example 2 is that Compressor A is a modulating compressor, that is, it may be driven by, for example, a variable speed drive, but compressors B and C are not modulating compressors. Compressors B and C may only be operated at 100% load (on) or 0% load (off). Using the identical methodology as set forth in EXAMPLE 1, the FCS program would estimate compressor staging for a 50 ton unit with a sensed MAT of 78° F., a SATSP of 58° F. and a VFDSP of 75% (0.75) to once again calculate a Step Number of 5.36

For this system, as discussed above, compressor A is a modulating compressor while neither compressor B nor C are modulating. However, in this system, instead of the FCS programming rounding the START STAGE or Step Number to the nearest whole number, the FCS programming interpolates between these values to the two nearest whole numbers. In this Example 2, the nearest START STAGE or Step Number are 5 and 6, while the calculated STEP NUMBER of 5.36 falls between these values. The FCS staging determines from Table 3, using the closer of the two Step Numbers in the Table to the calculated START STAGE or Step Number that at a Step #5 for a 50 ton refrigeration capacity unit having three compressors, compressor A should be cycled on at a load of 67%, and one of compressors B and C should be cycled on at a 100% load, while at a Start Stage #6, compressor A should be cycled on at a load 100%. Thus, at a START STAGE or Step Number greater than 5, here 5.36, it is clear that compressor A should be cycled on at a load value greater than the value of 67% listed in Table 3 for a START STAGE or Step # of 5 but less than 100% for a START STAGE or Step # of 6. The load value that compressor A should be cycled for a calculated START STAGE or Step # of 5.36 is calculated by interpolating as follows:

$$(5.36-5)*(1-0.67)+0.67.=0.79$$

The value of (1−0.67) represents the load setting differential between START STAGE or Step #5 and START STAGE or Step #6 from Table 3. (5.36−5) represents the amount (or percentage when multiplied by 100) above START STAGE or Step #5 that 5.35 is. By multiplying these values together a value of about 0.79 or 79% is calculated by the FCS program. So to satisfy a START STAGE or Step # of 5.36, the controller, receiving this information from the FCS program, instructs one of the non-modulating compressors B or C to cycle on, that is, operating at 100% load, while instructing the modulating compressor, compressor A in this Example, to be cycled on at a load of about 79% (0.788% represents the calculated load to three digits). In operation, compressor A would be started at 100%, and after a delay to avoid electrical overload, one of the remaining compressors B or C is brought on line at 100% and compressor A is modulated downward to a load of 79%.

EXAMPLE 3

An air conditioning system has 95 tons of refrigeration capacity and utilizes a fan having variable speed capabilities. For this Example 3, the 95 tons of refrigeration capacity are provided by six compressors A-F. While the capacity of each of the compressors may be provided in any manner using available compressors, for this example, Compressor A has 20 tons of cooling capacity, and compressors B-F each provide 15 tons of cooling capacity. Each of compressors A-E is capable of being modulated. As will be recognized by those skilled in the art, a total cooling capacity of 95 tons can be provided with a different compressor capacity per unit than set forth above. In order to perform cooling in accordance with this disclosure, the controller would run the FCS program to maximize cooling capacity while running the available compressors as efficiently as possible. On a call for cooling in a system having 95 tons of capacity, the sensors would allow the controller to calculate the MAT as described above. In this example SATSP is set at 58° F. In this example, the return air, using a sensed return air temperature, when mixed with the supply air provided at SATSP yields a calculated value of MAT of 78° F. In addition, the controller utilizes a VFDSP of 75%. The controller also determines, in this example, that the sensed outside conditions make economizer usage unsuitable. The controller is programmed for a 95 ton system, the 95 tons of cooling being supplied by six compressors, each operated by a variable speed drive and having variable fan speed (VFDSP) which is programmed on start up to operate at 75% capacity. It will be recognized by those skilled in the art that SATSP and VFDSP are values programmed into the FCS program, but which may be varied as desired by changing the programmed values. Return air temperature is a sensed value, and MAT is a calculated value based on the sensed return air temperature and the programmed SATSP.

Next the FCS program estimates START STAGE or Step # required. This value is calculated using Equation 1 above. MAT, SATSP and VFDSP are determined as discussed above. In order to determine STEP DELTA, the program next goes to Table 1, below, stored in the controller. STEP DELTA is stored in the controller and may be updated from time to time as required. From Table 1 it is determined that STEP DELTA for a 50 ton compressor system is 1.5. This number, if desired also may be entered into the FCS program at installation, since the total refrigeration capacity of the system is known at installation. However, it is preferred that the FCS program check Table 1 stored in the controller with each iteration of the program, since there is no additional effort required in executing the FCS program in this manner. It is also easier to update Table 1 in the controller by simply replacing it rather than having to reprogram the FCS program in the controller. Table 1 also indicates that there and a total of 18 available staging steps for a system having 95 tons of capacity utilizing six compressors.

The 1.5 input from Table 1 is used in Eq. 1 with a calculated MAT of 78° F., a SATSP of 58° F. and a VFDSP of 75% (0.75) 1 yielding a calculated START STAGE or Step #10.

Next, the compressor staging is determined. Table 5, also programmed into the controller, provides information on all 19 of the Step numbers for a system having compressor capacity in the 95-105 ton capacity range, which as discussed above, has six compressors. In this Example 3, a 95 ton cooling capacity system having six compressors, compressors A-F, utilizes START STAGE or Step #10 from Table 5. From Table 5, START STAGE or Step #5 indicates that compressor A should be cycled on at a load of 33%, and three of compressors B-F should be cycled on at a 100% load. As before, compressor A is brought on at 100% first and after the delay for electrical overload prevention, the remaining three compressors are activated. After the last compressor is activated, compressor A is modulated to a load of 33%.

The examples and tables set forth above are exemplary only and show how the FCS program can provide controller operation to sequence the start of compressor operation to maximize cooling in minimal time while optimizing efficiency. The systems set forth above include multiple compressor systems having compressor capacity from 25-105 tons DU and having between 2-6 compressors. The Tables address systems having compressor capacity with 2-6 compressors. However, the invention is not so restricted and the FCS program running in a controller may include more than 6 compressors. Furthermore, the FCS system running in a controller may be effective when overall tonnage attributed to the compressors in the system has cooling capacity of as little as 15 tons. Additionally, the FCS program imposes no theoretical limit on the number of compressors in the system. The overall tonnage of the system currently may be as high as 300 tons DU. However, other factors may determine the limits of the tonnage of the system as well as the number of compressors in the system. For example, cost may be a factor that dictates the use of a different refrigeration system than that described above, as tonnage capabilities increase and/or number of compressors increase. System efficiencies also may dictate the use of a different refrigeration system.

The above Tables provide discrete unit sizes for the compressors. However, the available unit sizes can be modified so that a system can be provided with any system size having capacity from 15 tons and higher. Table 1 provides the total number of steps available for a two compressor system having a cooling capacity of 25-40 tons, while Table 2 identifies the Compressor Staging for a system size in the range of 25-40 tons. By proper selection of the individual compressor capacity of two compressors, any system tonnage within the range may be obtained. Indeed, it is possible to devise a two compressor system with an overall capacity outside of the range of 25-40 tons or 15-40 tons, for example. So the overall determination of cooling start-up in accordance with the present invention is not dictated by system tonnage capacity, but by the number of compressors in the system.

The Tables also indicate that the number of compressors determines the number of total steps (STEP #s) or stages available. As the number of individual compressors in the system increases, so does the number of stages (STEP #) available. It is thus theoretically possible to have a system with higher tonnage but fewer available stages. For example, a system may have two compressors, one compressor with a capacity of 30 tons and another with a capacity of 35 tons for a total capacity of 65 tons, and thus having 6 available steps or stages. However, it is possible to have a three compressor system with less capacity than this two compressor system, the three compressor system having a first compressor with a capacity of 15 tons, a second compressor with a capacity of 20 tons and a third compressor with a capacity of 25 tons for a total capacity of 60 tons, but with 9 available steps or stages.

The controlling factor for the system thus is not the overall tonnage or the number of compressors, since both the tonnage and the number of compressors in the system can be manipulated to achieve almost any result. Factors that must be considered in having a controller staging compressors utilizing the FCS program are the thermal response of the system, the size of the building and the number of stages or steps available in the system. The stages or steps determine the number of compressors that are cycled on. The changes in monitored temperature within the building are not instantaneous and variables such as temperature and humidity do change overtime. However, the controller staging compressors, if determined by the FCS program incorrectly, can possibly overreact and overcool by cycling too many compressors on. This is undesirable, since cycling the compressors on and off too rapidly may result in damage to the compressors, or overcooling of the interior region. However, if an insufficient number of compressors is cycled on, it will increase the amount of time to achieve the temperature set point for the room. So, regardless of the stages or steps available or the cooling capacity of the system, the proper stage or step numbers selected by the active cooling start-up of the present invention desirably should provide compressor operation that will cycle the activated compressors for a time period longer than one minute but shorter than 10 minutes. Preferably, the selected stage will achieve the desired indoor temperature by cycling the compressors for a period of from 2-7 minutes and most preferably for about 3½ minutes. Thus, to prevent compressor damage, the controller will monitor compressor operation to assure that each compressor brought on-line in a stage operates for more than one minute. Because of the efficiencies achieved by the system, the controller will monitor each compressor brought on-line so that it is operational for no more than 10 minutes before being shut down.

When cooling start up is activated, preferably a modulating compressor or compressors are the first to be activated and operates at 100% capacity. As other compressors are cycled on, the modulating compressor capacity can be reduced to provide a step number or stage capacity that is fractional, as is set forth in the corresponding Table. That is to say, the modulating compressor when initially cycled on operates at full capacity. However, until additional compressor(s) are cycled on, the modulating compressor operating at full capacity is only providing a fraction of the cooling required at that STEP #. For example, using the STEP # in Example 2, calculated at 5.36, the modulating compressor, Compressor A, is first cycled on at 100%, but scaled back to achieve a partial load of 78% when one of the other compressors, Compressors B or C, is activated at 100% load, for example after a 5-20 second delay after the start of Compressor A. The use of the modulating compressor in this fashion provides greater system efficiency and lower operational cost.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for controlling an interior region temperature, comprising:

measuring an interior region temperature;

comparing the measured interior region temperature to an interior region set point temperature;

engaging an active cooling mode of a heating, ventilating, air conditioning, and refrigeration (HVAC&R) system when a difference in the measured interior region temperature and the set point temperature exceeds a predetermined amount;

calculating a step number of a plurality of compressors of the HVAC&R system based on an operating parameter of a mixed air stream, wherein the mixed air stream comprises outdoor air, return air, or both;

determining a compressor staging cycle of the plurality of compressors based on the step number, wherein the compressor staging cycle comprises a first compressor of the plurality of compressors and a second compressor of the plurality of compressors;

activating the first compressor of the plurality of compressors; and activating the second compressor after a predetermined amount of time passes from activation of the first compressor.

2. The method of claim 1, wherein the operating parameter of the mixed air stream comprises a temperature of the mixed air stream.

3. The method of claim 2, wherein the temperature of the mixed air stream is calculated based on a first temperature of the outdoor air and a second temperature of the return air.

4. The method of claim 2, wherein the temperature of the mixed air stream is determined using a sensor configured to monitor a temperature of a mixture of the outdoor air and the return air.

5. The method of claim 1, wherein the operating parameter of the mixed air stream comprises an enthalpy of the mixed air stream.

6. The method of claim 5, wherein the enthalpy of the mixed air stream is calculated based on a first enthalpy of the outdoor air and a second enthalpy of the return air.

7. The method of claim 5, wherein the enthalpy of the mixed air stream is determined using a sensor configured to monitor an enthalpy of a mixture of the outdoor air and the return air.

8. The method of claim 1, wherein calculating the step number of the plurality of compressors of the HVAC&R system based on the operating parameter of the mixed air stream comprises calculating the step number based on a variable supply fan speed setting, wherein the variable supply fan speed setting is a value between 0 and 100% or a fractional value between 0 and 1.

9. The method of claim 1, comprising determining whether a user activates a user selectable operation for a fast compressor start operation before engaging the active cooling mode.

10. The method of claim 1, comprising determining a type of refrigerant installed in the HVAC&R system and selecting a fast compressor start program from a plurality of fast compressor start programs before engaging the active cooling mode, wherein selecting the fast compressor start program from the plurality of fast compressor start programs is based on the type of refrigerant.

11. The method of claim 1, comprising:

monitoring an outdoor environmental condition;

determining whether to operate an economizer of the HVAC&R system based on the outdoor environmental condition and a cooling demand; and activating the economizer when the outdoor environmental condition indicates that the economizer may contribute to satisfying the cooling demand.

12. The method of claim 1, wherein the predetermined amount of time is a time sufficient to avoid electrical overload resulting from compressor start up.

13. The process of claim 12, wherein the time sufficient to avoid electrical overload resulting from compressor start up is between 5 and 20 seconds.

14. A system for controlling an interior region temperature, comprising:

one or more tangible, non-transitory machine-readable media comprising processor-executable instructions to:

measure an interior region temperature;

compare the measured interior region temperature to an interior region set point temperature;

engage an active cooling mode of a heating, ventilating, air conditioning, and refrigeration (HVAC&R) system when a difference in the measured interior region temperature and the set point temperature exceeds a predetermined amount;

calculate a step number of a plurality of compressors of the HVAC&R system based on an operating parameter of a mixed air stream, wherein the mixed air stream comprises outdoor air, return air, or both;

determine a compressor staging cycle of the plurality of compressors based on the step number, wherein the compressor staging cycle comprises a first compressor of the plurality of compressors and a second compressor of the plurality of compressors;

activate the first compressor of the plurality of compressors; and activate the second compressor after a predetermined amount of time passes from activation of the first compressor.

15. The system of claim 14, wherein the one or more tangible, non-transitory machine-readable media comprising processor-executable instructions is configured to operate the first compressor, the second compressor, or both for a period of time longer than one minute but less than ten minutes.

16. The system of claim 14, wherein the operating parameter of the mixed air stream comprises a temperature of the mixed air stream, an enthalpy of the mixed air stream, or both.

17. The system of claim 14, wherein the predetermined amount of time is a time sufficient to avoid electrical overload resulting from compressor start up, and wherein the time sufficient to avoid electrical overload is between 5 and 20 seconds.

18. A method for controlling an interior region temperature, comprising:

measuring an interior region temperature;

comparing the measured interior region temperature to an interior region set point temperature;

engaging an active cooling mode of a heating, ventilating, air conditioning, and refrigeration (HVAC&R) system when a difference in the measured interior region temperature and the set point temperature exceeds a predetermined amount;

determining a compressor staging cycle for a plurality of compressors of the HVAC&R system based on an operating parameter of a mixed air stream, wherein the mixed air stream comprises outdoor air, return air, or both, and wherein the compressor staging cycle comprises a sequence of operating at least two compressors of the plurality of compressors;

activating a first compressor of the plurality of compressors to a first load, wherein the first compressor is a modulating compressor;

activating a second compressor of the plurality of compressors after a predetermined amount of time passes from activation of the first compressor; and adjusting a speed of the first compressor, such that the first compressor operates at a second load, different from the first load.

19. The method of claim 18, wherein activating the second compressor of the plurality of compressors after the predetermined amount of time passes from activation of the first compressor comprises activating the second compressor to a third load.

20. The method of claim 19, wherein the second compressor is a modulating compressor, and wherein the third load is less than 100% load of the second compressor.

21. The method of claim 18, wherein the predetermined amount of time is a time sufficient to avoid electrical overload resulting from compressor start up.

22. The method of claim 21, wherein the time sufficient to avoid electrical overload is between 5 and 20 seconds.

23. The method of claim 18, wherein the operating parameter of the mixed air stream comprises a temperature of the mixed air stream, an enthalpy of the mixed air stream, or both.

* * * * *